US005706744A

United States Patent [19]

Card et al.

[11] Patent Number: 5,706,744

[45] Date of Patent: *Jan. 13, 1998

[54] METHOD AND APPARATUS FOR PRODUCING TUFTS FROM DIFFERENT YARNS IN LONGITUDINAL LINES

[75] Inventors: Roy T. Card, Chattanooga, Tenn.; Wilton Hall, Fort Oglethorpe, Ga.

[73] Assignee: Card-Monroe Corp., Hixson, Tenn.

[ * ] Notice: The term of this patent shall not extend beyond the expiration date of Pat. No. 5,224,434.

[21] Appl. No.: 604,817

[22] Filed: Feb. 23, 1996

Related U.S. Application Data

[63] Continuation of Ser. No. 275,077, Jul. 14, 1994, Pat. No. 5,499,588, which is a continuation of Ser. No. 66,780, May 24, 1993, abandoned, which is a continuation of Ser. No. 934,292, Aug. 24, 1992, Pat. No. 5,224,434, which is a continuation of Ser. No. 653,766, Feb. 11, 1991, abandoned.

[51] Int. Cl.[6] ..... D05C 15/30

[52] U.S. Cl. ..... 112/80.41; 112/80.52; 112/475.23

[58] Field of Search ..... 112/80.41, 80.01, 112/80.52, 80.55, 475.23

[56] References Cited

U.S. PATENT DOCUMENTS

| | | | |
|---|---|---|---|
| 3,084,645 | 4/1963 | Card . | |
| 3,138,126 | 6/1964 | Card . | |
| 3,301,205 | 1/1967 | Card . | |
| 3,396,687 | 8/1968 | Nowicki . | |
| 3,577,943 | 5/1971 | Watkins . | |
| 3,881,432 | 5/1975 | Dodd et al. . | |
| 3,919,953 | 11/1975 | Card et al. . | |
| 3,972,295 | 8/1976 | Smith . | |
| 4,103,629 | 8/1978 | Card . | |
| 4,119,049 | 10/1978 | Puckett . | |
| 4,173,192 | 11/1979 | Schmidt et al. . | |
| 4,217,837 | 8/1980 | Beasley et al. . | |
| 4,226,196 | 10/1980 | Booth . | |
| 4,366,761 | 1/1983 | Card . | |
| 4,398,479 | 8/1983 | Czelusniak, Jr. . | |
| 4,440,102 | 4/1984 | Card et al. . | |
| 4,483,261 | 11/1984 | Green et al. . | |
| 4,557,209 | 12/1985 | Watkins . | |
| 4,562,781 | 1/1986 | Green . | |
| 4,619,212 | 10/1986 | Card et al. . | |
| 4,630,558 | 12/1986 | Card et al. . | |
| 4,754,718 | 7/1988 | Watkins . | |
| 4,800,828 | 1/1989 | Watkins . | |
| 4,815,403 | 3/1989 | Card et al. . | |
| 4,836,118 | 6/1989 | Card et al. | 112/80.41 |
| 4,841,886 | 6/1989 | Watkins . | |
| 4,903,624 | 2/1990 | Card et al. . | |
| 4,903,625 | 2/1990 | Card et al. | 112/80.41 X |
| 5,058,518 | 10/1991 | Card et al. . | |
| 5,224,434 | 7/1993 | Card et al. | 112/80.41 |
| 5,499,588 | 3/1996 | Card et al. | 112/80.41 |

FOREIGN PATENT DOCUMENTS

| | | |
|---|---|---|
| 1 545 258 | 5/1979 | United Kingdom . |
| 2 104 925 | 3/1983 | United Kingdom . |
| 2 165 560 | 4/1986 | United Kingdom . |

OTHER PUBLICATIONS

Carpet Sample "B" (Undated) (attached to C3, Frost Letter dated Mar. 14, 1990).

Carpet Sample "1" (undated).

(List continued on next page.)

*Primary Examiner*—Paul C. Lewis

*Attorney, Agent, or Firm*—Isaf, Vaughan & Kerr

[57] ABSTRACT

Front and rear needle bars are provided with front and rear needles for inserting yarns into a backing material. An excess of front loopers are provided for the front needles and an excess of rear loopers are provided for the rear needles. The front loopers respectively face the rear loopers and are respectively aligned with each other. The needle bars are shifted laterally so as to provide longitudinal rows of tufts formed by the front needles providing spacing between the tufts of a longitudinal row which space is filled in by the tufts of rear needles.

20 Claims, 3 Drawing Sheets

OTHER PUBLICATIONS

Carpet Sample "2" (undated).
Carpet Sample "3" (undated).
Carpet Sample "4" (undated).
Carpet Sample "5" (undated).
Carpet Sample "6" (undated).
Carpet Sample "7" (undated).
Carpet Sample "8" (undated).
Carpet Sample "9" (undated).
Carpet Sample "10" (undated).
Carpet Sample "11" (undated).
Carpet Sample "12" (undated).
Carpet Sample "13" (undated).
Carpet Sample "14" (undated).
Carpet Sample "15" (undated).
Tuftco Corp., Specification Sheet, Collins and Aikman Corp., Dec. 2, 1987, Shop order No. 27419.
Tuftco Corp., Gauge Parts Order—Cut Pile: Customer: Collins and Aikman Corp., Machine SC–162 Multituft (undated), Shop Order No. 27419.
Tuftco Corp., Gauge Parts Order—Loop Pile—Customer: Collins and Aikman Corp., Machine SC–162 Multituft (undated), Shop Order No. 27419.

Beasley, Max M. (Tuftco Corp.), Letter to Commissioner of Patents, Apr. 2, 1990, pp. 1–2.

Carpet Sample "A" (Undated).

Frost, Steven. L. (Tuftco Corp.), Letter dated Mar. 14, 1990 (includes C4 below as attachment).

Letter of Apr. 10, 1990 from Jack L. Frost of Tuftco Corp. to Card–Monroe Corp.

Photocopy of carpet sample (undated).

Letter dated Mar. 26, 1990 from G. W. Dewhirst of Sanderson to Tuftco Corp.

Diagram attached to letter dated Mar. 26, 1990 from G. W. Dewhirst of Sanderson to Tuftco Corp.

Tuftco's Velv–a–loop brochure, four pages.

Singer's Omnipoint brochure, four pages.

METHOD AND APPARATUS FOR PRODUCING TUFTS FROM DIFFERENT YARNS IN LONGITUDINAL LINES

CROSS REFERENCE TO RELATED APPLICATIONS

This application is a continuation of application Ser. No. 08/275,077, filed Jul. 14, 1994 (now U.S. Pat. No. 5,499,588), which was a continuation of application Ser. No. 08/066,780, filed May 24, 1993 (now abandoned), which was a continuation of application Ser. No. 07/934,292, filed Aug. 24, 1992 (now U.S. Pat. No. 5,224,434), which was a continuation of application Ser. No. 07/653,766, filed Feb. 11, 1991 (now abandoned).

BACKGROUND OF THE INVENTION

This invention relates to tufting machines and is more particularly concerned with an apparatus and method for producing tufts from different yarns in common longitudinal rows.

In the past, the tufting industry has long sought for an easy and efficient way of producing tufts from different yarn in selected single, longitudinal rows. Thus, stop needle machines were produced in which the needles of the tufting machine were aligned longitudinally but were selectively operated so that one needle sewed a portion of a longitudinal row while the other was stopped. Such machines were impractical for high speed tufting and were expensive to build, maintain and program.

Another form of prior art tufting machine which could produce tufts of different characteristics was the machine which had "cut-loop loopers." Such a machine had a cut pile looper with a spring clip which enabled the yarn feed mechanism to control, by the amount of yarn feed to the needle, whether the yarn formed a cut pile or a loop pile. The successive tufts in a longitudinal row, however, had to be from a single yarn and precluded multicolor tufts from different yarns in a single row.

Another form of providing a multicolored appearance in a tufted product was by producing high cut pile tufts in one row to overlie low loop pile in an adjacent row.

Still another method of tufting to produce a multicolored pattern involved the use of laterally shiftable front and back needle bars which enabled the needles of one needle bar to be moved so as to cooperate, selectively, with different laterally spaced loopers. All needles were inserted into the backing material for each reciprocation, however, the needles of one needle bar were always staggered with respect to the needles of the other needle bar and the front loopers were staggered with respect to the rear loopers. In such prior art machines, the shift of one needle bar with respect to the other, had to be a lateral distance equal to at least two gauges of tufting. U.S. Pat. No. 4,366,761 illustrates such a machine. The shifting by two gauges causes the accumulation of excessive yarns in the back stitches. By having to shift one needle bar two gauges with respect to the other, this prevented making a continuous diagonal row of tufts, using a selected yarn or yarns. Therefore, a diagonal line of tufting in a tufted product has had to appear as broken lines, formed by a succession of spaced discrete pin dots.

SUMMARY OF THE INVENTION

Briefly described, the present invention includes a tufting machine having pairs of longitudinally aligned loopers for cooperating with laterally shiftable needle bars. At times, the needles of one needle bar are longitudinally aligned with the needles of the second needle bar. Also at times, there are an excess of loopers for each row of needles, some or all of which are longitudinally aligned. The loopers can have a more narrow gauge than the needles so that longitudinal rows of the backing can be shared, thereby permitting a shift of a single gauge by either needle bar. This single gauge, lateral shifting enables the machine to produce a wide variety of fabrics which include diagonal rows formed of one or a plurality of yarns.

It is an object of the present invention to provide a tufting machine which can produce longitudinal rows of tufts, in which each longitudinal row can contain cut and uncut tufts of different yarns.

Another object of the present invention is to provide a tufting machine which can tuft different sizes or types of yarn as loop or cut pile in the same longitudinal row or rows.

Another object of the present invention is to provide a tufting machine which can provide one or more cut or looped tufts in adjacent rows.

Another object of the present invention is to provide a tufting machine which is capable of producing carpeting having a multitude of colors and textured patterns achieved through varying the threading and varying the shift sequence of the needle bars.

Another object of the present invention is to provide a tufting machine and a process of tufting which requires no buried or hidden short loops in order to produce patterned tufted fabrics which can contain cut tufts and looped tufts of uniform or different heights and different colored yarns.

Another object of the present invention is to provide a tufting machine and method of tufting in which the tufted fabric retains a full density of face yarn throughout the fabric.

Another object of the present invention is to provide a tufting machine and method of tufting which will minimize the amount of yarn in the back stitches, due to shifting of the needle bars.

Another object of the present invention is to provide a tufting machine and method of tufting in which the diagonals appearing in the pattern of the tufted fabric can be created by either a single or a plurality of yarn or yarns of a color different from the other yarns in the fabric.

Another object of the present invention is to provide a tufting machine and process of tufting which will produce longitudinal rows of cut pile with one, two, or three adjacent yarns and with loop pile yarns which have been shifted over the back stitch of the straight row or rows and vice-versa.

Another object of the present invention is to provide a tufting machine and method of tufting which can produce adjacent longitudinal rows of loop and cut pile without shifting of the fabric and which will retain the maximum density of the face yarn of the fabric.

Another object of the present invention is to provide a tufting machine and method of tufting which can obtain a tip sheared look (which, in the prior art, was achieved by shearing the high loops) without the extra step of tip shearing and without any appreciable loss of yarn.

Another object of the present invention is to provide a tufting machine and method of tufting which will produce a tufted fabric having a uniformly, random tip sheared look.

Another object of the present invention is to provide a tufting machine and method of tufting in which the needles can be shifted a single or a multiple of a single gauge, namely one, two, three or four gauges.

Another object of the present invention is to provide a tufting machine in which there can be longitudinal rows of loop pile and cut pile of different yarns and wherein the loop pile tufts are not thrust through the cut pile tufts.

Another object of the present invention is to provide a tufting machine and method of tufting in which the gauge integrity of the resulting fabric is maintained.

Another object of the present invention is to provide a tufting machine and method of tufting which will produce a tufted fabric having a woven Wilton appearance.

Another object of the present invention is to provide a tufting machine which can produce patterns and diagonals in a tufted fabric and still run at a standard tufting speed.

Another object of the present invention is to provide a tufting machine and method of tufting which will produce patterns and diagonals in the tufted product and can still run off of beams which save space in the plant and reduce waste (both in the tubes and on the cones of the creels) and are capable of making shorter rows, economically.

Another object of the present invention is to provide a tufting machine and method of tufting in which the pattern produced in the face yarns can be varied in color and texture or can be in texture only (cut pile and loop pile) or in color variations from cut pile with respect to loop pile.

Another object of the present invention is to provide a tufting machine and method of tufting which can be used for producing patterned goods from different sizes or types of yarns in the loop tufts and also in size and type in the cut pile, whereby various colors of yarns may be used or various twist levels of different types of yarns may be used.

Another object of the present invention is to provide a tufting machine in which different mixes of needles can be arranged on a plurality of needle bars, the needles being grouped for example in three adjacent needles on one bar for providing space capable of being filled in by the needles of the other needle bar.

Another object of the present invention is to provide a tufting machine and method of tufting which can make cut or uncut tufts in the central portion of the fabric or produce pin dots in the central portion and all loops or all cut tufts in the borders of the fabric.

Another object of the present invention is to provide a tufting machine and method of tufting in which the center portion of the tufted fabric can be all loop pile and the borders can be all cut pile or vice-versa.

Other objects, features, and advantages of the present invention will become apparent from the following description when taken in conjunction with the accompanying drawings wherein like characters of reference designate corresponding parts throughout the several views.

DETAILED DESCRIPTION

Figure 1:
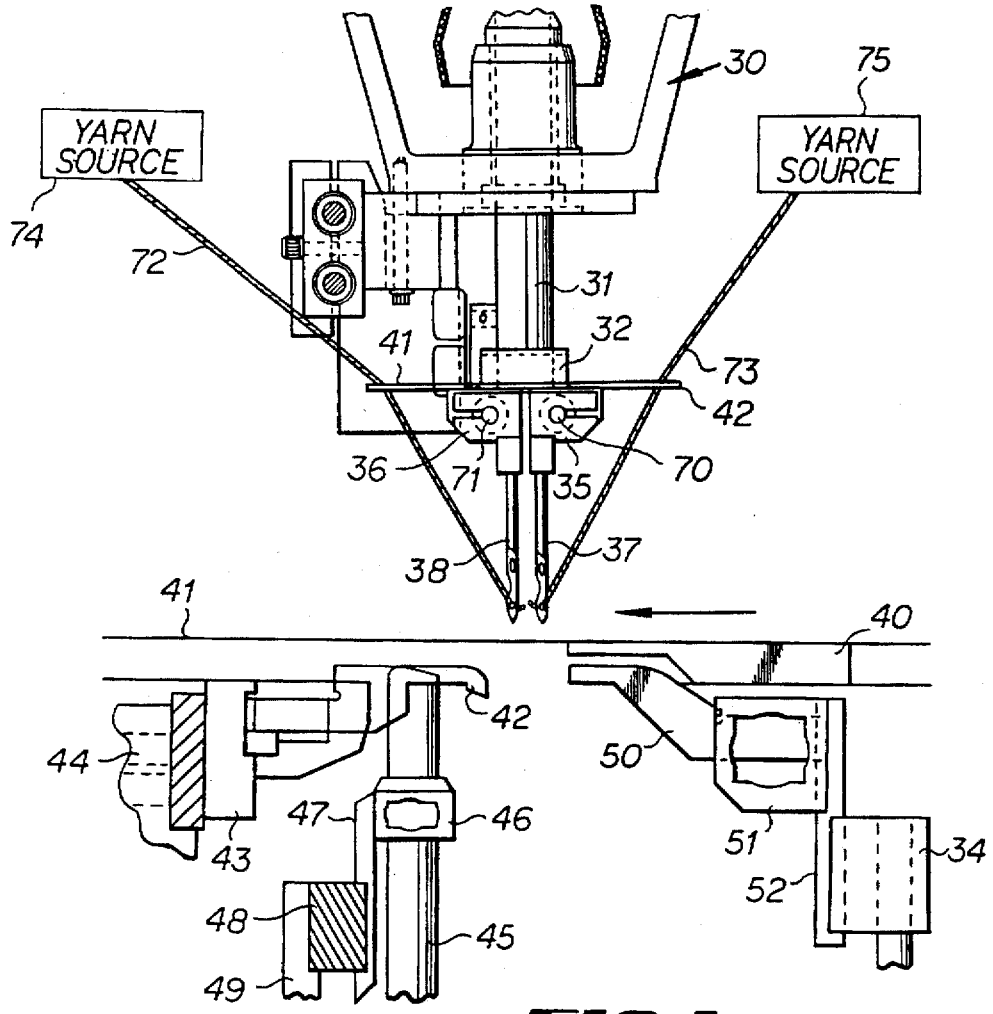
FIG. 1 is a fragmentary vertical sectional view of a tufting machine constructed in accordance with the present invention.

Referring now in detail to the embodiment chosen for the purpose of illustrating the present invention, numeral 30 in FIG. 1 indicates generally a conventional tufting machine which has push rods 31 which are reciprocated along their respective axes upwardly and downwardly, the push rods being provided at their lower end with a transversely extending needle bar support 32. The needle bar support 32 has, along its lower surface, a pair of transversely extending, laterally shiftable, parallel needle bars 35 and 36. The front needle bar 35 is provided with a row of transversely aligned, front needles 37 and the rear needle bar 36 is provided with a row of transversely aligned rear needles 38.

The tufting machine 30 also has a bed 40, over which the backing material 41 passes, the backing material 41 being disposed beneath the needles 37 and 38, so that the needles 37 and 38 simultaneously insert yarns 72 and 73 through the hacking material, upon reciprocation of the needle bar support 32.

Below the backing material 41 the tufting machine 30 in FIG. 1 is provided with a plurality of cut pile loopers 42 the bills of which extend forwardly opposite to the direction of travel of the backing material 41 and cooperate with the rear needles 38 so as to catch and hold the loops of yarn sewn by these needles 38. These cut pile loopers 42 are carried by looper block 43 supported by a rocker assembly, denoted generally by the numeral 44. According to the present invention, the number of loopers 42 may and usually do exceed, substantially, the number of needles 38 and are of a more narrow gauge than the gauge spacing of needles 38.

Each looper 42 is provided with cut pile knife blade 45 carried by a block, such as block 46, the block 46 being supported at one end of a staff 47 which extends upwardly from the staff supporting bar 48 on a knife rocker assembly, denoted generally by numeral 49. The loops of yarn gathered by loopers, such as looper 42, are urged rearwardly of the machine 30 as they are carried by the backing material 41 and so that the loops are eventually pulled into the path of the knife blades, such as blade 45, and are severed or cut while they remain on the cut pile loopers 42. Thus all of the tufts accumulated on the cut pile loopers 42 will eventually be cut pile tufts.

Forwardly of the cut pile loopers 42 are the loop pile loopers, such as looper 50 in FIG. 1, each looper 50 being carried by a looper block 51 supported on a staff 52, from a loop pile rocker assembly, denoted generally by numeral 34.

Figure 2:
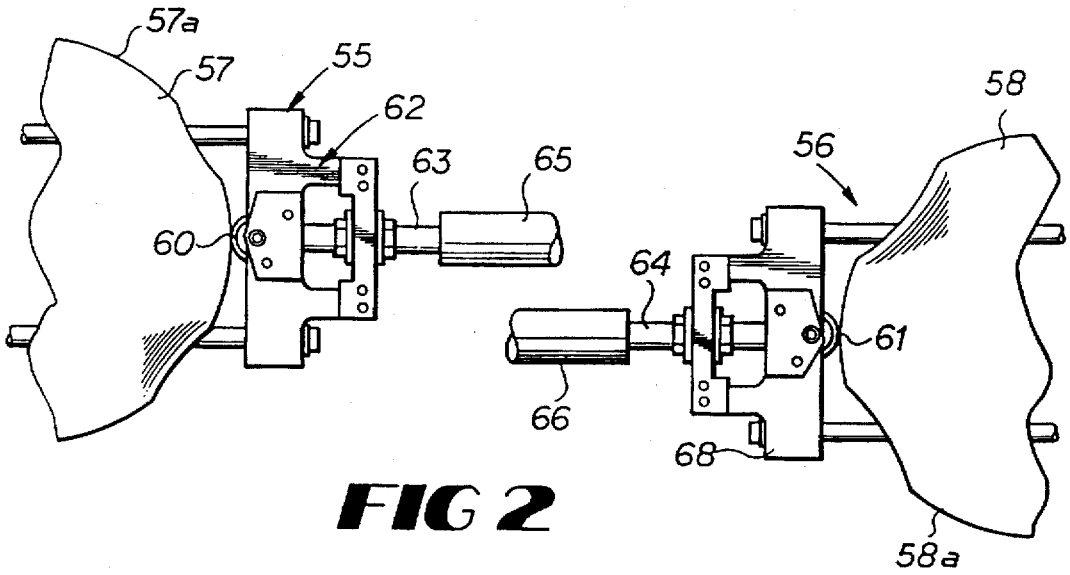
FIG. 2 is a fragmentary side elevational view showing the two needle bar control members which respectively control the lateral shifting of the needle bars of the tufting machine illustrated in FIG. 1.

In the present invention, the needle bars 35 and 36 are controlled by a pair of needle bar shift controls, denoted by the numerals 55 and 56 in FIG. 2. The needle bar shift control 55 includes a rotatable cam disc 57, rotatable about a fixed axis, the disc 57 being provided with a peripheral cam surface 57*a* having recesses and protrusions. A cam follower 60 rides along the peripheral cam surface 57*a* of the disc 57 and is carried by a shiftable frame 62. A second cam follower (not shown) is diametrically opposed to follower 60, also on frame 62. In like fashion, a second cam disc 58 has a peripheral cam surface 58*a* which engages cam followers, such as cam follower 61 to move a frame 68.

As seen in FIG. 2, the cam discs 57 and 58 are adapted to control, respectively, the lateral shifting of the needle bars 35 and 36, the peripheries of the disc forming camming surfaces 57*a* and 58*a*, respectively.

Cam followers, such as cam followers 60 and 61, on the respective shift controls 55 and 56, ride along the peripheries 57*a* and 58*a* of disc 57 and 58 so as to move the frames 62 and 68 laterally, as dictated by the peripheries 57*a* and 58*a*. The frames 62 and 68, in turn, are connected, via push rods 63 and 64, to links 65 and 66. Links 65 and 66, in turn, manipulate respectively the control rods 70 and 71, seen in FIG. 1, which protrude from the ends of needle bars 35 and 36.

Yarns 72 and 73 from yarn sources 74 and 75, such as creels or beams, are withdrawn at uniform rates and passed through yarn guides 41 and 42 to the needles 37 and 38, the yarns 72 being fed to the back or rear transverse row of needles 38 and the yarns 73 being fed to the front transverse row of needles 37. Patterned high-low loop tufts can be readily produced by substituting a conventional yarn control mechanism for the yarn source 75.

Figure 3:
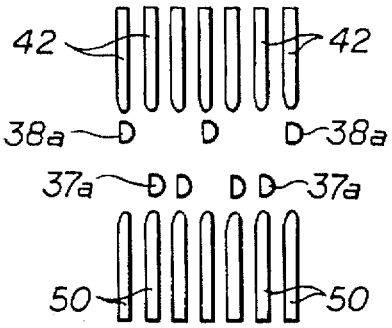
FIG. 3 is a schematic horizontal sectional view of the needles and the needle bars of the tufting machine shown in FIG. 1.
Figure 4:
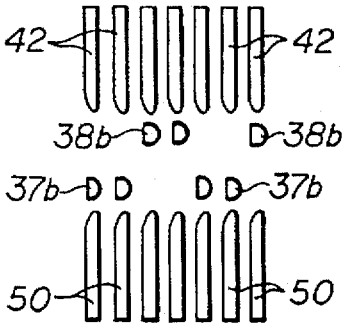
FIG. 4 is a view similar to FIG. 3 but showing a different spacing of the needles in the two needle bars.
Figure 5:
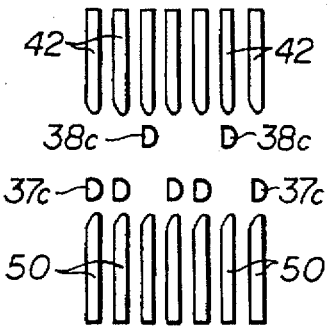
FIG. 5 is a view similar to FIGS. 3 and 4 and showing still another spacing of the needles of the two needle bars.
Figure 6:
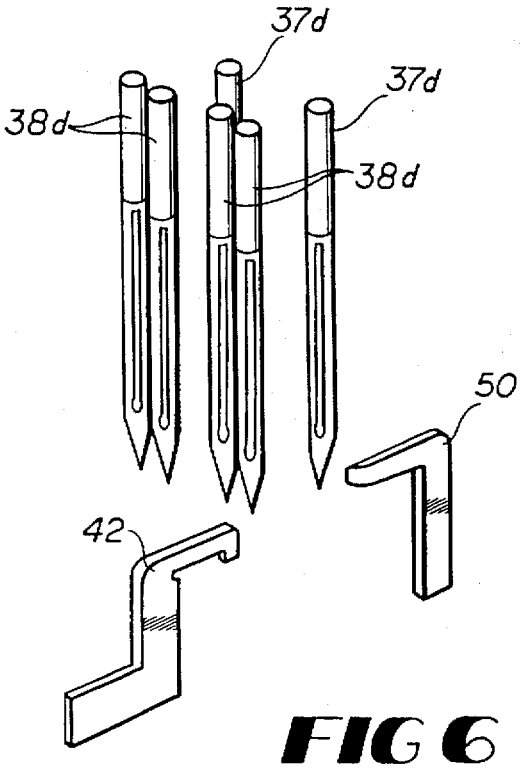
FIG. 6 is a fragmentary perspective view showing yet another spacing of some of the needles and their associated loopers.

An important feature of the present invention is that the bills of front loopers 50 are respectively aligned with the bills of rear loopers 42. In FIG. 3, 4 and 5 are shown different arrangements of needles 37 and 38 with respect to the loopers 42 and 50, the needles which are substituted for front needles 37 being labeled needles 37*a*, 37*b*, 37*c* and the needles substituted for needles 38 being labeled 38*a*, 38*b*, and 38*c*.

In FIG. 3 pairs of needles 37*a* are spaced from each other by a spacing twice as wide as the spacing of their associated loopers 50 and the rear needles 38*a* are spaced from each other by a spacing which is three times the spacing of its associated loopers 42. Thus, through appropriate lateral shifting of one or both needle bars 35 and 36 for the needles 37*a* and 38*a*, by one, two or three loopers, left or right, only one needle 37*a* or needle 38*a* is sewing in a prescribed longitudinal row.

In FIG. 4, the front needles 37*b*, are arranged in spaced pairs along the transverse length of the tufting machine whereby the axes of the needles 37*b* of each pair are one gauge apart and the space between the axes of the adjacent needles 37*b* in adjacent pairs are spaced apart by a plurality (two) gauges.

The center lines of the adjacent front loop pile loopers 50 are all evenly transversely spaced apart by a single gauge while the center lines of the adjacent cut pile loopers 42 are evenly transversely spaced apart by a single gauge, the loop pile loopers 50 being respectively longitudinally aligned with each other.

The front loop pile loopers 50 are all in transverse alignment with each other and the cut pile loopers 42 are transversely aligned with each other. Furthermore, all of the cut pile loopers 42 rock forward as the loop pile loopers 50 rock forwardly and vice versa. The loopers 42 and 50 do not move laterally but simply rock toward and away from each other. Thus, when a needle 37*a*, 37*b* or 37*c* is appropriately positioned laterally, by one, two or three or more gauges, it is moved downwardly adjacent a prescribed looper 50 so that a loop of yarn 73 will be caught and momentarily held by the looper 50 and released after the needle 37*a*, 37*b* or 37*c* is retracted from backing 41.

In like fashion, the needles 38*a*, 38*b* or 38*c* are shifted laterally by one, two or three or more gauges and are moved downwardly, and their yarns are caught and cut by the cut pile looper assembly.

To synchronize the cams, the actions of the rear cam should be delayed from the action of the front cam, so that with a ⅜ " stagger for the needles and 8 stitches per inch, there should be a 3 stitch cam delay for the back cam with respect to the front cam; with 10.68 stitches/inch there should be a 4 stitch cam delay for the back cam with respect to the front cam; and with 13.33 stitches/inch there should be a 5 stitch cam delay between the front and back cam. With 16 stitches/inch a 6 stitch cam delay is required.

This is calculated in that a stagger of 0.375 inches or ⅜ inches divided by cam delay in revolutions equals the length of each stitch. Thus, the longitudinal distance between the center lines of front and back rows of needles, divided by the cam delay in revolutions of the machine equals the longitudinal distance between adjacent stitches (length of each stitch).

In FIG. 3 it is seen that the rear needles 38*a* are spaced from each other so as to provide one needle for every third looper 42 and that each of the front needles are arranged in adjacent pairs, there being a space of one looper between each pair of adjacent needles. By such an arrangement, the fabric depicted in FIGS. 7 and 8 may be provided. Thus, without shifting the front needle bar, spaced rows of loop pile tufts 137*a* are sewn along spaced, parallel lines and the cut pile tufts 138*a* are produced by lateral shifting of the rear needle bar so as to produce in the backing material 41*a* a plurality of cut pile tufts in which the yarns 72 form the back stitches seen in FIG. 8 and the yarns 73 form the loop pile tufts 137*a*.

Figure 8:
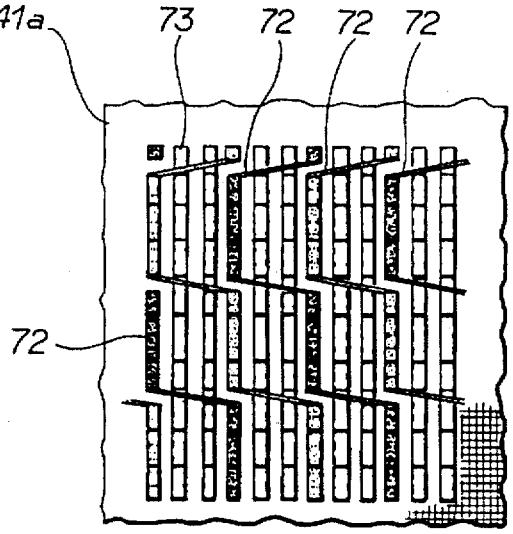
FIG. 8 is a fragmentary schematic bottom plan view of the fabric depicted in FIG. 7.

By laterally shifting the back needle bar only, the yarns 72, which are varied in color from the yarns 73 and can be varied in color from each other, produce a back stitch as indicated in FIG. 8 and the tufts indicated by numeral 138*a*, in the backing material 41*a*.

Figure 9:
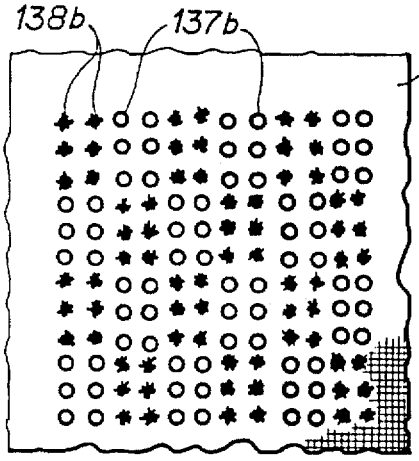
FIG. 9 is a fragmentary schematic plan view of the face yarns in fabric produced when the needles are arranged as shown in FIG. 4.
Figure 10:
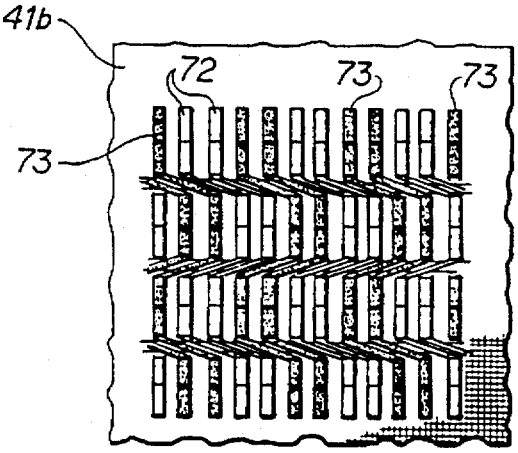
FIG. 10 is a fragmentary schematic bottom plan view of the fabric depicted in FIG. 9.

In FIGS. 9 and 10 is shown a tufting arrangement which is accomplished utilizing the needle spacing of FIG. 4. Here, by lateral shifting of both needle bars, the loop pile tufts 137*b* and the cut pile tufts 138*b* are produced in the backing material 41, the back stitching being formed by the yarns 72 and 73 as depicted in FIG. 10.

Figure 11:
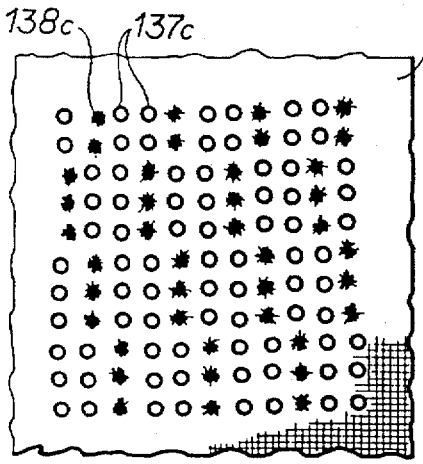
FIG. 11 is a fragmentary schematic plan view of the face yarns in fabric produced when the needles are arranged as shown in FIG. 5.
Figure 12:
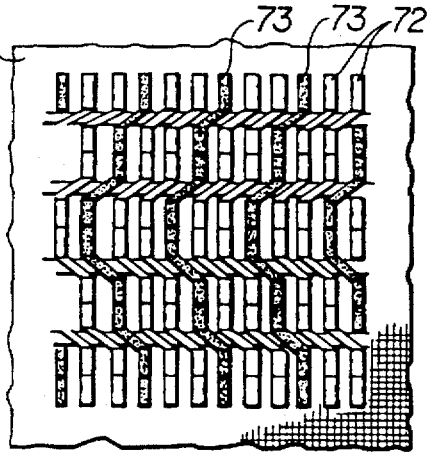
FIG. 12 is a fragmentary schematic bottom plan view of the fabric depicted in FIG. 11.

In FIGS. 11 and 12 are shown a pattern which can be produced utilizing the needle spacing depicted in FIG. 5. Here, the pairs of front needles 37*c* produce the tufts 137*c* as the back needles 38*c* produce the loop pile tufts 138*c*, the back stitching therefor being shown in FIG. 12. Here both needle bars are shifted and the yarns 72 produce the loop pile tufts 137*c* as the yarns 73 produce the cut pile tufts 138*c*.

Figure 7:
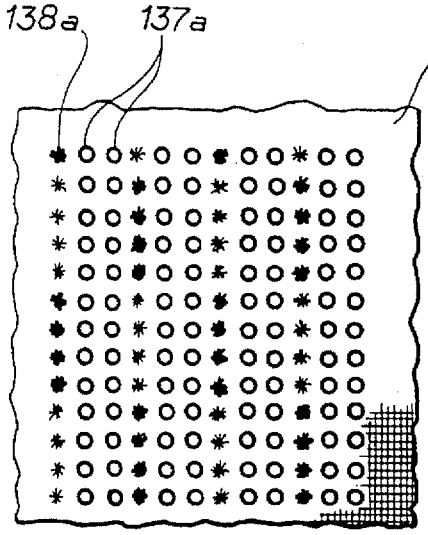
FIG. 7 is a fragmentary schematic plan view of the face yarns in fabric produced when the needles are arranged as shown in FIG. 3.

By providing a spacing of more than one looper between selected needles, and through appropriate shifting laterally of the needle bars, single longitudinal rows of tufts which selectively have both loop pile and cut pile are produced, as illustrated in FIGS. 7, 9, and 11.

It will be obvious to those skilled in the art that many variations may be made in the embodiment here chosen for the purpose of illustrating the present invention, without departing from the scope thereof as defined by the appended claims.

We claim:

1. A tufting machine, for tufting yams in a backing material passing longitudinally in a downstream direction through said tufting machine, comprising: a plurality of front loop pile loopers transversely arranged across a width of said tufting machine with each of said from loop pile loopers spaced from an adjacent front loop pile looper by a predetermined distance;

a plurality of rear cut pile loopers transversely arranged across said width of said tufting machine with each of said rear cut pile loopers spaced from an adjacent rear cut pile looper by said predetermined distance so that said front loop pile loopers are longitudinally aligned with said rear cut pile loopers, said rear cut pile loopers being spaced from said front loop pile loopers in said downstream direction;

a first set of front needles aligned with each other across said width of said tufting machine between said front loopers and said rear loopers, said first set of front needles being fewer in number than said plurality of front loopers; and a second set of rear needles aligned with each other across said width of said tufting machine between said front needles and said rear loopers, said second set of rear needles being fewer in number than said plurality of rear loopers.

2. The tufting machine as set forth in claim 1, further comprising a shifting mechanism for shifting said first set of front needles across said width of said tufting machine.

3. The tufting machine as set forth in claim 2, wherein said shifting mechanism shifts said first set of front needles in multiples of said predetermined distance.

4. The tufting machine as set forth in claim 1, further comprising a shifting mechanism for shifting said second set of rear needles across said width of said tufting machine.

5. The tufting machine as set forth in claim 4, wherein said shifting mechanism shifts said second set of rear needles in multiples of said predetermined distance.

6. A carpet tufting machine for passing a backing material longitudinally in a direction of feed and for placing yams in said backing material in longitudinal tuft rows, including a support frame having a bed, push rods supported by said frame and disposed over said bed, transversely shiftable front and rear needle bars suspended by said push rods over said bed, front needles arranged in a row carried by said front needle bar; rear needles arranged in a row carried by said rear needle bar, shifting mechanisms cooperating with said needle bars for moving said needle bars transversely with respect to said longitudinal direction of feed, a first yam source disposed adjacent to said frame for supplying first yams to said front needles and a second yam source disposed adjacent to said frame for supplying second yams to said rear needles, front and rear loopers disposed below said bed, and arranged in transverse rows of loopers to cooperate with said needles, the improvement comprising:

said front loopers being loop pile loopers and said rear loopers being cut pile loopers, said front loopers extending in the direction of feed of said backing material and said rear loopers extending opposite the direction of feed of said backing material, and wherein each of said loopers being spaced from a transversely adjacent looper a prescribed gauge such that the number of said loopers are at least twice the number of said needles, said front loopers and said rear loopers being in sufficient longitudinal alignment and said front needles being spaced from said rear needles a sufficient distance to permit said first yams to be tufted in a first longitudinal tuft row and said second yams also to be tufted in said first longitudinal tuft row upon shifting of said front and rear needle bars, said front needles and said rear needles being arranged in spaced groups.

7. A carpet tufting machine for passing a backing material longitudinally in a direction of feed and for placing yarns in said backing material in longitudinal tuft rows, including a support frame having a bed, push rods supported by said frame and disposed over said bed, transversely shiftable front and rear needle bars suspended by said push rods over said bed, front needles arranged in a row carried by said front needle bar; rear needles arranged in a row carried by said rear needle bar, shifting mechanisms cooperating with said needle bars for moving said needle bars transversely with respect to said longitudinal direction of feed, a first yam source disposed adjacent to said frame for supplying first yarns to said front needles and a second yam source disposed adjacent to said frame for supplying second yarns to said rear needles, front and rear loopers disposed below said bed, and arranged in transverse rows of loopers to cooperate with said needles, the improvement comprising:

said front loopers being loop pile loopers and said rear loopers being cut pile loopers, said front loopers extending in the direction of feed of said backing material and said rear loopers extending opposite the direction of feed of said backing material, and wherein each of said loopers being spaced from a transversely adjacent looper a prescribed gauge such that the number of said loopers are at least three times the number of said needles, said front loopers and said rear loopers being in sufficient longitudinal alignment and said front needles being spaced from said rear needles a sufficient distance to permit said first yarns to be tufted in a first longitudinal tuft row and said second yarns also to be tufted in said first longitudinal tuft row upon shifting of said front and rear needle bars, said front needles and said rear needles being arranged in spaced groups.

8. A carpet tufting machine for passing a backing material longitudinally in a direction of feed and for placing yarns in said backing material in longitudinal tuft rows, including a support frame having a bed, push rods supported by said frame and disposed over said bed, a drive mechanism for driving said push rods, transversely shiftable front and rear needle bars suspended by said push rods over said bed, front needles arranged in a row carried by said front needle bar, rear needles arranged in a row carried by said rear needle bar, shifting mechanisms cooperating with said needle bars for moving said needle bars transversely with respect to said longitudinal direction of feed, a first yarn source disposed adjacent to said frame for supplying first yarns to said front needles and a second yarn source disposed adjacent to said frame for supplying second yarns to said rear needles, from and rear loopers disposed below said bed, and arranged in transverse rows of loopers to cooperate with said needles, the improvement comprising:

said front loopers being loop pile loopers and extending toward said rear loopers in the direction of backing material feed, said rear loopers being cut pile loopers and extending toward said front loopers opposite the direction of backing material feed, said needles of said front needle bar and said rear needle bar being arranged in spaced groups, said shifting mechanism for said rear needle bar being selectively controllable to impart a delay in shifting said rear needle bar, and said yarns being placed in said backing in spaced, adjacent tufts in said longitudinal tuft rows, said longitudinal distance between adjacent tufts equal to the longitudinal distance between said row of needles along said front needle bar and said row of needles on said rear needle bar divided by the stitch delay per revolutions of said main shaft to permit tufts of said second yarns to be placed in the same longitudinal row as said tufts of said first yarns.

9. A carpet tufting machine for passing a backing material longitudinally in a direction of feed and for placing yarns in said backing material in longitudinal tuft rows, including a support frame having a bed, push rods supported by said frame and disposed over said bed, transversely shiftable front and rear needle bars suspended by said push rods over said bed, front needles arranged in a row carried by said front needle bar, rear needles arranged in a row carried by said rear needle bar, shifting mechanisms cooperating with said needle bars for moving said needle bars transversely with respect to said longitudinal direction of feed, a first yarn source disposed adjacent to said frame for supplying first yarns to said front needles and a second yarn source disposed adjacent to said frame for supplying second yarns to said rear needles, front and rear loopers disposed below said bed, and arranged in transverse rows of loopers to cooperate with said needles, the improvement comprising:

said front loopers being longitudinally in line in the direction of feed with said rear loopers, said front loopers comprising loop pile loopers and said rear loopers comprising cut pile loopers, said row of front loopers being more in number than said number of said front needles and said row of rear loopers being more in number than said rear needles, and the bills of said front loopers extending in the direction of feed and the bills of said rear loopers extending opposite the direction of feed, and wherein said needles are arranged in spaced groups.

10. A carpet tufting machine for passing a backing material along a longitudinal path in a direction of feed and for placing tufts of first and second yarns spaced in longitudinal tuft rows in said base fabric comprising:

(a) a frame;

(b) a bed supported by said frame;

(c) push rods journeled by said frame for reciprocation upwardly and downwardly;

(d) a front needle bar and a rear needle bar supported by said push rods for [separate]reciprocation with said push rods;

(e) a drive mechanism carried by said frame for driving the reciprocation of said push rods and said needle bars;

(f) a front shifting mechanism cooperating with said front needle bar and a rear shifting mechanism cooperating with said rear needle bar;

(g) front loop pile loopers disposed in a transverse front row of loopers below said bed for cooperating with said front needles and the bills of said loop pile loopers extending in said direction of feed of said backing material;

(h) rear cut pile loopers disposed in a transverse rear row of loopers below said bed for cooperating with said rear needles and the bills of said cut pile loopers extending opposite said direction of feed of said backing material;

(i) said needles in said front row of needles being fewer in number than said loopers in said front row of loopers;

(j) said needles in said rear row of needles being fewer in number than said loopers in said rear row of loopers;

(k) said loopers in said from row of loopers being in line in the direction of feed of said base fabric with the said loopers in said rear row of loopers; and (l) said needles being selectively arranged in spaced groups to permit tufts of said first yarns to be intermixed with tufts of said second yarns in the same longitudinal tuft rows in a predetermined pattern.

11. The tufting machine defined in claim 10, and the number of loopers in said front row of loopers substantially exceeding the number of needles in said front row of needles.

12. The tufting machine defined in claim 11, and the number of loopers in said rear row of loopers substantially exceeding the number of needles in said rear row of needles.

13. The tufting machine defined in claim 10, and the number of loopers in said rear row of loopers substantially exceeding the number of needles in said rear row of needles.

14. The tufting machine defined in claim 10, and the loopers in said front row of loopers being spaced at a more narrow gauge than the gauge of the needles in said front row of needles.

15. The tufting machine defined in claim 10, and the loopers in said rear row of loopers being spaced at a more narrow gauge than the gauge of the needles in said rear row of needles.

16. The tufting machine defined in claim 10 and the loopers in said front row of loopers being of a more narrow gauge than the gauge of the needles of the front row of needles and the loopers of the rear row of loopers being of a more narrow gauge than the gauge of the needles of the rear row of needles.

17. Method of tufting carpet in which a longitudinal tuft row is created in a backing material, said longitudinal tuft row comprising mils of first yarns and of second yarns, comprising the steps of:

(a) feeding said backing material in a longitudinal path;

(b) disposing a front needle bar and a rear needle bar each having needles in spaced groups above said backing material (c) disposing front loop pile loopers and rear cut pile loopers below said backing material, the total number of said front and rear loopers being at least twice the total number of said needles in said front and rear needle bars;

(d) inserting a first yarn into said backing material by moving said from needle bar toward said backing material so that the spaced groups of needles of said front needle bar penetrate said backing material;

(e) creating a loop from said first yarns;

(f) repeating steps (a)–(e) until a first longitudinal row of looped tufts is created;

(g) shifting said rear needle bar;

(h) inserting a second yarn into said backing material in said first longitudinal row by moving said rear needle bar toward said backing material so that the spaced groups of needles of said rear needle bar penetrate said backing material;

(i) creating a loop from said second yarn;

(j) cutting said loop of said second yarn; and (k) repeating steps (h)–(j), wherein said longitudinal row is comprised of looped tufts of said first yarns intermixed with cut tufts of said second yarns.

18. Method of tufting carpet in a carpet tufting machine for passing a backing material along a longitudinal path and inserting first and second yarns into said backing material, said tufting machine having a frame, a drive mechanism carried by said frame, push rods attached to and driven by said drive mechanism, a front needle bar and rear needle bar carried by said push rods for reciprocating movement, a bed supported by said frame below said needle bars, front loop pile loopers disposed below said bed and extending in the direction of said longitudinal path, rear cut pile loopers disposed below said bed and extending opposite said longitudinal path and shifting mechanisms for shifting said needle bars, comprising the steps of:

(a) feeding said backing material along said longitudinal path across said bed;

(b) inserting said first yarns in spaced groups into said backing material by reciprocating said from needle bar toward said bed;

(c) creating loops of said first yarns in said backing material in longitudinal rows by moving said loop pile loopers toward said needles of said front needle bar and reciprocating said front needle bar away from said bed;

(d) shifting said rear needle bar transversely;

(e) inserting said second yarns in spaced groups into said backing material by reciprocating said rear needle bar toward the bed;

(f) creating loops of said second yarns in said backing material in longitudinal rows by moving said rear row of loopers toward said rear row of needles and reciprocating said rear row of needles away from said bed;

(g) cutting said loops of said second yarns; and (h) repeating steps (a)–(g) so that longitudinal tuft rows are created in said backing material, said tuft rows including looped tufts created from said first yarns and cut tufts created from said second yarns.

19. The method of tufting carpet defined in claim 18, wherein the total number of loopers are at least twice the total number of needles in the front and rear needle bars.

20. The method of tufting carpet defined in claim 18, wherein the total number of loopers is at least three times the total number of needles in the front and rear needle bars.

* * * * *

UNITED STATES PATENT AND TRADEMARK OFFICE

CERTIFICATE OF CORRECTION

PATENT NO. : 5,706,744
DATED : January 13, 1998
INVENTOR(S) : Roy T. Card, Wilton Hall It is certified that error appears in the above-identified patent and that said Letters Patent is hereby corrected as shown below:

At column 4, line 41, delete "hacking" and insert --backing--.

At column 7, line 7, delete "yams" and insert --yarns--.

At column 7, line 11, delete "from" and insert --front--.

At column 7, line 45, delete "yams" and insert --yarns--.

At column 7, line 54, delete "yam" and insert --yarn--.

At column 7, line 56, delete "yams" and insert --yarns--.

At column 7, line 56, delete "yam" and insert --yarn--.

At column 7, line 57, delete "yams" and insert --yarns--.

At column 8, line 5, delete "yams" and insert --yarns--.

At column 8, line 6, delete "yams" and insert --yarns--.

UNITED STATES PATENT AND TRADEMARK OFFICE

CERTIFICATE OF CORRECTION

PATENT NO. : 5,706,744
DATED : January 13, 1998
INVENTOR(S) : Roy T. Card, Wilton Hall It is certified that error appears in the above-identified patent and that said Letters Patent is hereby corrected as shown below:

At column 8, line 20, delete "yam" and insert --yarn--.

At column 8, line 22, delete "yam" and insert --yarn--.

At column 8, line 57, delete "from" and insert --front--.

At column 9, line 49, delete "[separate]".

At column 10, line 3, delete "from" and insert --front--.

At column 10, line 36, delete "mils" and insert --tufts--.

At column 10, line 48, delete "from" and insert --front--.

At column 11, line 15, delete "from" and insert --front--.

Signed and Sealed this

Eighth Day of December, 1998

Bruce Lehman

*Attest:*

BRUCE LEHMAN

*Attesting Officer*

*Commissioner of Patents and Trademarks*